US006558118B1

(12) United States Patent
Brisson et al.

(10) Patent No.: US 6,558,118 B1
(45) Date of Patent: May 6, 2003

(54) BUCKET DOVETAIL BRIDGE MEMBER AND METHOD FOR ELIMINATING THERMAL BOWING OF STEAM TURBINE ROTORS

(75) Inventors: Bruce William Brisson, Galway, NY (US); Mark Edward Burnett, Buskirk, NY (US); Frederick George Baily, Ballston Spa, NY (US); David Alan Caruso, Ballston Lake, NY (US); Norman Arnold Turnquist, Sloansville, MI (US); Christopher Edward Wolfe, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/985,183

(22) Filed: Nov. 1, 2001

(51) Int. Cl.[7] ..... F01D 11/00

(52) U.S. Cl. ..... 415/173.7; 415/174.2; 415/231

(58) Field of Search ..... 415/173.7, 174.2, 415/174.5, 231, 173.3, 173.5, 173.4, 174.4, 176, 178, 230

(56) References Cited

U.S. PATENT DOCUMENTS

| | | | | |
|---|---|---|---|---|
| 6,168,377 | B1 | 1/2001 | Wolfe et al. | |
| 6,290,232 | B1 * | 9/2001 | Reluzco et al. | 277/355 |
| 6,431,827 | B1 * | 8/2002 | Wolfe et al. | 415/173.3 |

* cited by examiner

*Primary Examiner*—Edward K. Look
*Assistant Examiner*—James M McAleenan
(74) *Attorney, Agent, or Firm*—Nixon & Vanderhye

(57) ABSTRACT

A steam turbine has a rotor mounting axially spaced rotor wheels having male dovetails for mounting a plurality of axially spaced buckets having female dovetails. A plurality of arcuate bridging members extend axially between the axially adjacent bucket dovetails at locations spaced radially outwardly of the surface of the rotor shaft. A diaphragm in radial opposition to the bridging member mounts a brush seal having bristles engaging the bridging member. The bridging member carries backup labyrinth seal teeth for sealing with the diaphragm. The friction generated by contact between the brush seal bristles and bridging members lies radially outwardly of the rotor whereby non-uniform distribution of heat about the rotor surface due to frictional contact with the brush seal is avoided, with consequent avoidance of rotor bowing.

20 Claims, 2 Drawing Sheets

BUCKET DOVETAIL BRIDGE MEMBER AND METHOD FOR ELIMINATING THERMAL BOWING OF STEAM TURBINE ROTORS

BACKGROUND OF THE INVENTION

The present invention relates to a steam turbine having a brush seal between non-rotatable and rotatable components arranged and located to eliminate thermal bowing resulting from non-uniform distribution of heat about the rotatable component due to heat generated by frictional contact between the brush seal and the rotatable component and particularly relates to apparatus and methods for locating the contact between the brush seal and rotatable component radially outwardly of the rotor shaft.

In U.S. Pat. No. 6,168,377 of common assignee herewith, there is disclosed a steam turbine having a brush seal located between a non-rotatable component and a rotatable component of the rotor shaft. As explained in that patent, brush seals typically comprise a plurality of metal bristles projecting from the stationary component and engaging the surface of the rotor. Sustained rubbing between the rotor and the brush seal can lead to thermal bowing of the rotor or exacerbate an existing bowed condition of the rotor. As disclosed in that patent, it is recognized that the contact between the brush seal and the sealing surface should be located radially outwardly of the rotor shaft in order to isolate the generated heat from the outer diameter of the rotor. Otherwise, the friction-generated heat may cause a non-uniform temperature distribution about the circumference of the shaft, resulting in a bow in the rotor. While various methods and apparatus are disclosed in that patent for eliminating that problem, one such solution located the brush seal/friction-generating surface of the rotor to a bridge mounted on bucket dovetail flanges radially outboard of the shaft diameter. In that manner, the generated heat is isolated from the rotor, eliminating any tendency of the rotor to bow.

In a companion application Ser. No. 09/985,638, combined brush and labyrinth seals are mounted on the stationary component for sealing engagement with axially projecting flanges on axially adjacent bucket dovetails. As in U.S. Pat. No. 6,168,377, the frictional contact area of the brush seal bristles and the flanges of the buckets is spaced radially outwardly of the shaft, tending to minimize or eliminate rotor shaft bowing due to non-uniform distribution of heat about the shaft caused by the heat generated from such frictional contact.

Applying brush seals in the diaphragm packing area, i.e., the stationary component, is currently limited in the number of stages the brushes may be installed due to the aforementioned rotor dynamic constraints. Where brush seals cannot be used, labyrinth-type packing seals are used which result in a decrease in section efficiency due to the increased secondary losses of the labyrinth packing seals relative to the brush seal. Also, conventional labyrinth-type packing on the inside of the diaphragm web as a backup to a brush seal results in a dramatic thrust change to the rotor in the event of brush seal failure.

BRIEF SUMMARY OF THE INVENTION

In accordance with a preferred embodiment of the present invention, there are provided apparatus and methods for eliminating thermal bowing of a rotor shaft of a turbine resulting from non-uniform distribution of heat about the rotor shaft due to heat generated by frictional contact between a brush seal and the rotatable component. Particularly, there is provided a plurality of arcuate bridging members which are located and have an axial span between the wheels, particularly the bucket dovetails, of adjacent stages of the turbine. The bridging members are spaced radially outwardly of the rotor shaft surface and provide a sealing surface for engagement by the bristle tips of brush seals carried by the web of a diaphragm forming part of the non-rotatable component. The brush seal is located radially outwardly of the rotor shaft surface and at an upstream location along a leakage path between the non-rotatable and rotatable components. The contact area is also located in radial registration with a wheelspace void whereby heat transfer resulting from the frictional contact of the brush seal and sealing surface occurs axially and radially and thus dissipates before thermally affecting the rotor shaft surface.

The bridging members have axial end edges which cooperate with surfaces on the bucket dovetails to form tongue-and-groove connections with the adjacent stages. Additionally, the rotor shaft carries an annular rim projecting radially outwardly from the rotor shaft surface and substantially centrally between adjacent stages. The rim and the bridging members have cooperating dovetail connections such that the bridging member is substantially centrally supported between the adjacent stages. Further, one or more labyrinth teeth form a labyrinth seal between the diaphragm web and the bridging member. Preferably, the teeth are mounted on the bridging member and project radially outwardly toward the diaphragm web. The labyrinth seal serves as a backup seal in the event of failure of the brush seal.

The bridging members are readily applied to the turbine stages. Particularly at a radial entry location, the outer flange of a groove formed on each of the axially adjacent bucket dovetails and a portion of the adjacent bucket dovetails are removed, permitting radial entry of the bridging member. The bridging member can then be displaced in a circumferential direction about the rotor shaft to a final location. Upon installation of all bridging members, the final bridging member at the radial entry location may be staked or otherwise secured, for example, by screws, to the bucket dovetail at that location.

In a preferred embodiment according to the present invention, there is provided a steam turbine comprising a rotatable component including a rotor shaft carrying axially adjacent bucket rows and a non-rotatable component about the rotatable component, the rotor shaft having a shaft surface, a bridging member extending generally axially between the adjacent bucket rows at a location spaced radially outwardly of the shaft surface and mounted for rotation with the rotatable component and a brush seal carried by the non-rotatable component for sealing engagement with the bridging member.

In a further preferred embodiment according to the present invention, there is provided in a steam turbine having a rotatable component including a rotor shaft having a rotor shaft surface and a non-rotatable component about the rotatable component carrying a brush seal for sealing engagement with the rotatable component, a method of substantially eliminating bowing of the rotor resulting from circumferential non-uniform distribution of heat about the rotor shaft surface due to frictional contact between the brush seal and the rotatable component, comprising the step of inhibiting circumferential non-uniform heat transfer to the rotor shaft surface generated by frictional contact between the rotatable component and the brush seal by extending a bridging member between axially spaced bucket dovetails at a location radially outwardly of the rotor shaft and engaging the brush seal against the bridging member.

DETAILED DESCRIPTION OF THE INVENTION

Figure 1:
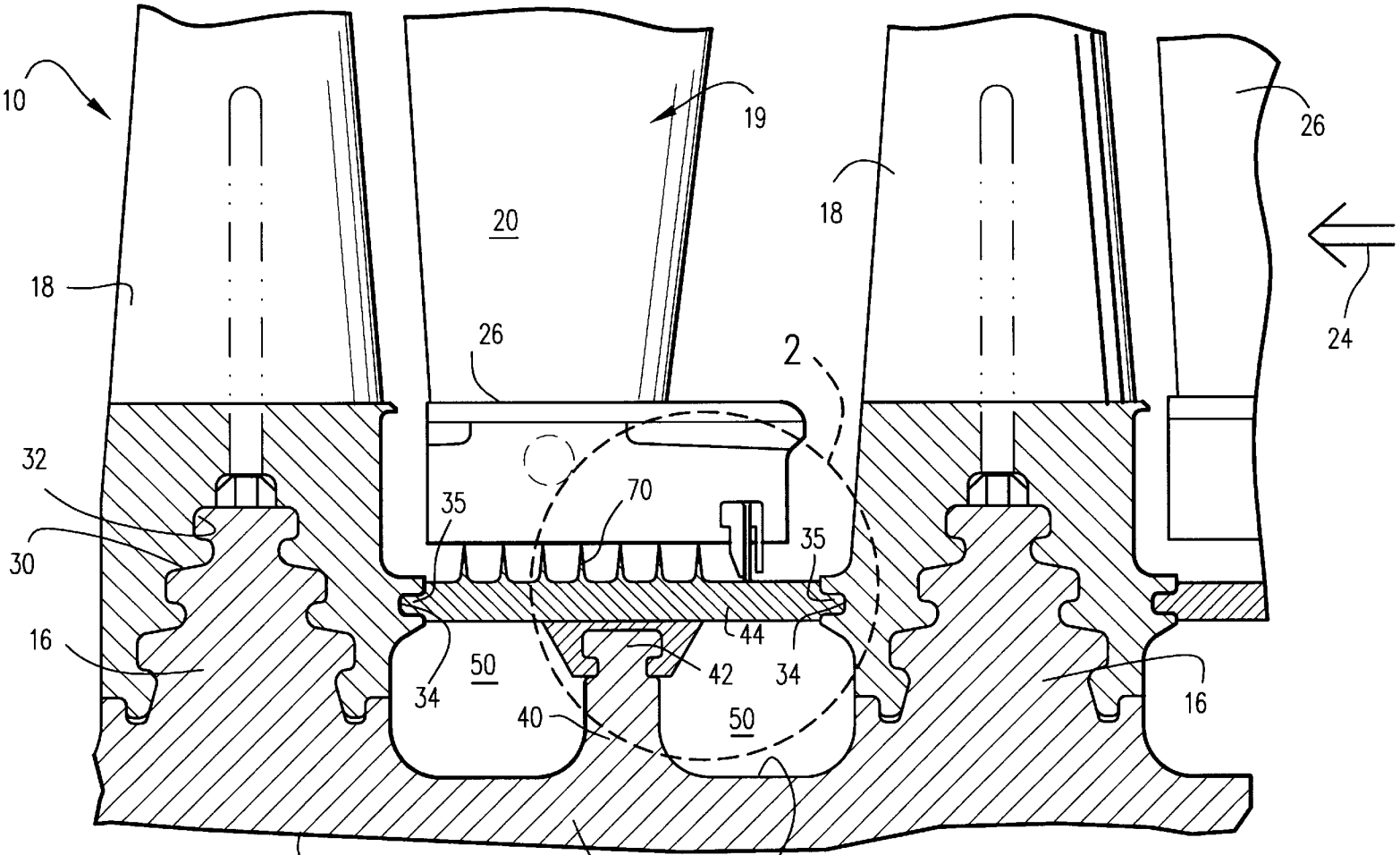
FIG. 1 is a fragmentary axial cross-sectional view of a rotor of a steam turbine illustrating rotor wheel buckets and nozzles.

Referring now to FIG. 1, there is illustrated a steam turbine, generally designated 10, having a rotatable component, generally designated 12, including a rotor shaft 14 mounting a plurality of axially spaced wheels 16 in turn mounting axially spaced steam turbine buckets 18. Between axially adjacent buckets, there is a non-rotatable component or diaphragm, generally designated 19, comprised of a series of nozzle partitions 20 and which partitions, together with buckets 18, form a steam flowpath through the steam turbine generally in the direction of the arrow 24. The partitions 20 are attached to an inner web 26 radially spaced from the outer diameter or surface 28 of the rotor shaft 14, the partitions 20 and the web 26 jointly forming the diaphragm 19. It will be appreciated that the rotor shaft 14 is a continuous solid elongated metal piece.

As illustrated in FIG. 1, wheels 16 have circumferentially extending male dovetails 30 and each of the buckets 18 includes a complementary-shaped female dovetail 32. It will be appreciated that the buckets are applied to the wheels in a circumferential direction, i.e., tangential entry buckets, with the male dovetail 30 of wheel 16 receiving the female dovetails 32 of buckets 18.

As illustrated in FIG. 1, and except between end stages of the turbine, the axially opposed faces of the bucket dovetails 32 are provided with channels 34 which open axially toward one another. It will be appreciated that the channels 34 are arcuate and essentially comprise an arcuate groove 35 between radially spaced adjacent flanges 36 and 38. Thus, each set of axially facing dovetails 32 of the buckets includes the channel 34 and the channels 34 form a substantially continuous axially opening annular groove 35.

Additionally, between axially adjacent wheels 16, there is provided a radially outwardly projecting, annular rim 40 terminating in a circumferentially extending male dovetail 42. The rim 40 may be formed integrally with the shaft 14 or applied to the shaft as a fabricated part.

A plurality of bridging members 44 in the shape of an arcuate segment extend between axially adjacent bucket dovetails 32. Each bridging member 44 has at axially opposite ends a projecting tongue 46 for reception within channels 34. Also, along a radial inner face of the bridging member 44, there is provided a female dovetail 48 for receiving the male dovetail 42 on rim 40. With the bridging member 44 axially spanning between axially adjacent female dovetails of the buckets and spaced radially outwardly of the surface 28 of the rotor 14, it will be appreciated that one or more wheelspace voids 50 are provided between the bridging member 44 and the surface 28 of shaft 14. Preferably, the arcuate circumferential length of each bridging member 44 is about 1.5 bucket pitches of the bucket dovetail.

Figure 2:
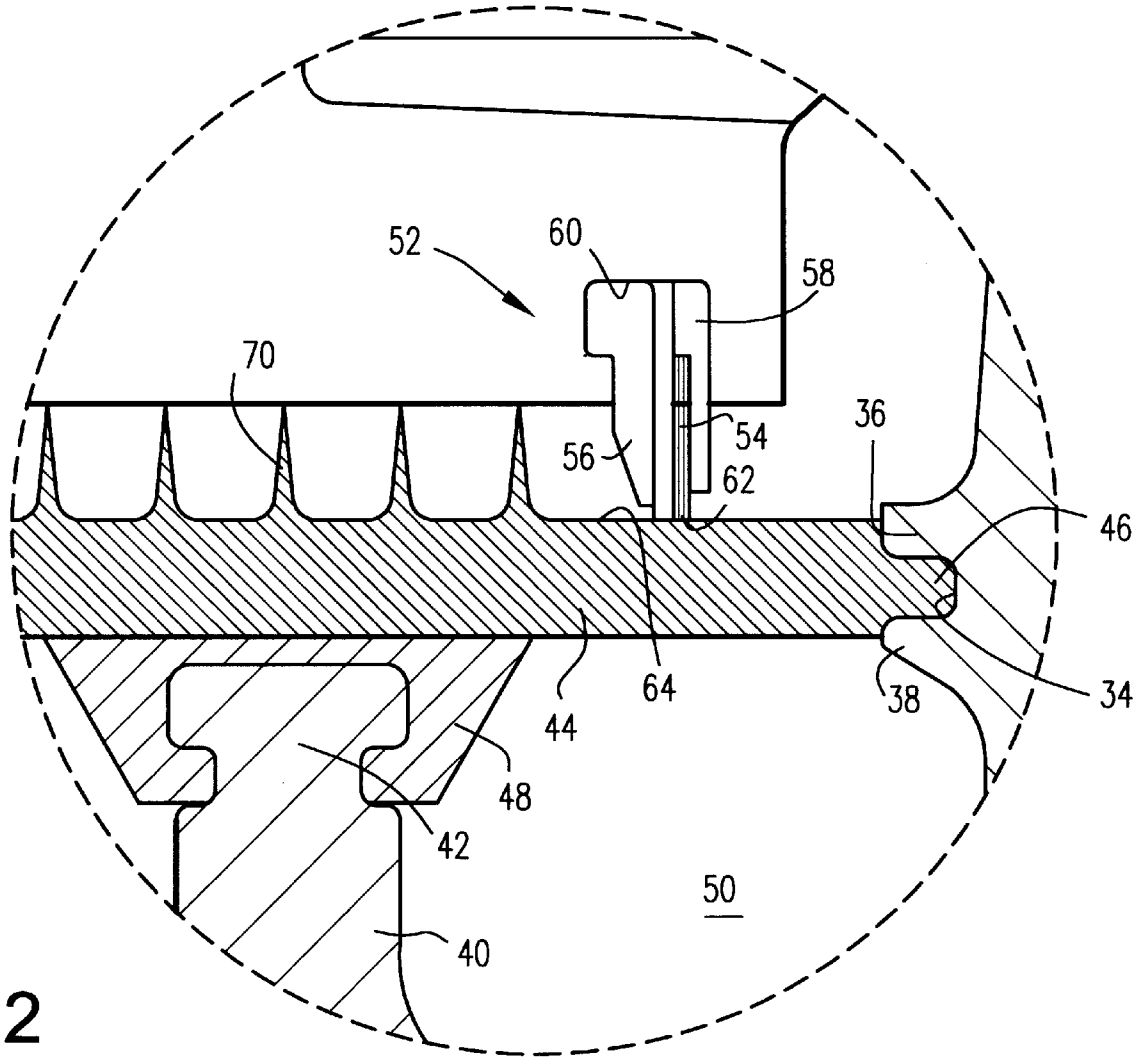
FIG. 2 is an enlarged cross-sectional view illustrating the interaction of the brush seal, labyrinth teeth and the bridging member.

Seals are provided between the diaphragm 19, i.e., the stationary component, and the bridging member 44 to seal the steam leakage flowpath therebetween. On the upstream side of the seals, there is provided a brush seal, generally designated 52. The brush seal 52, as best illustrated in FIG. 2, includes a plurality of preferably metal bristles 54 arranged in an arcuate array and engaged between plates 56 and 58. As illustrated, the brush seal 52 is mounted in an arcuate slot 60 formed along the inner radial surface of the diaphragm 19. The bristles 54 project radially inwardly of and beyond the inner edges of the backing plates 56 and 58. The bristles 54 have tips 62 which engage the circumferentially extending outer surface 64 of the bridging member 44 to form a seal therewith. It will be appreciated that the frictional contact between the bristles and the sealing surface bridging member 44 generates heat. However, because the location of that contact is radially outboard of the surface 28 of shaft 14 and is spaced therefrom by both the bridging member 44 and the rim 40, the generated heat does not substantially migrate to the rotor shaft per se. That is, the frictionally generated heat dissipates before deleteriously affecting the rotor surface 28. Therefore, non-uniform distribution of heat about the rotor surface 28 and consequent bowing of the rotor do not result.

Axially downstream and substantially at the same radial location of the brush seal are one or more labyrinth teeth 70 forming a labyrinth seal between the stationary component, i.e., diaphragm 19, and the bridging member 44. The labyrinth teeth 70 are mounted on the outer radial surface of the bridging member 44 and project radially outwardly. The teeth have tapered ends which form a tortuous labyrinth sealing path with the adjacent surface of the web 26. Consequently, the labyrinth teeth provide a labyrinth seal backup to the primary brush seal. Thus, should the brush seal 52 fail, the labyrinth seal teeth 70 substantially compensate for the loss of sealing capacity of the brush seal. It will be appreciated that the bridging member can be provided between axially adjacent wheels at any location along the axis of the steam turbine rotor. Also, the pressure distribution in the wheelspace cavities 50 does not change if the brush seal fails and thus axial thrust loads on the rotor from leakage flows past the backup labyrinth seals are avoided.

The bridging members 44 are in the form of arcuate segments, preferably having a length approximately one-and-one-half times the arcuate length of the bucket dovetails. The bridging members are installed circumferentially likewise as the buckets. To install the bridging members 44, a portion of a flange 36 of a bucket and a half of a flange of an adjacent bucket are removed to permit radial entry of the bridging member segments. Following radial entry, the bridging members 44 are displaced circumferentially about the rotor to a final location. Similarly, the dovetail 42 is interrupted at the entry location of the bridging members. Thus, the final bridging member 44 may be disposed radially against the radial inner flange 38 and secured. Preferably, grub screws are provided to secure the final bridging member segment to the adjacent bucket dovetail, the grub screws being staked to preclude the possibility of backing out during turbine operation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A steam turbine comprising:

a rotatable component including a rotor shaft carrying axially adjacent bucket rows and a non-rotatable component about said rotatable component, said rotor shaft having a shaft surface;

a bridging member extending generally axially between said adjacent bucket rows at a location spaced radially outwardly of said shaft surface and mounted for rotation with said rotatable component, said bridging member engaging said adjacent bucket rows; and a brush seal carried by said non-rotatable component for sealing engagement with said bridging member.

2. A turbine according to claim 1 wherein said non-rotatable component has a diaphragm with an inner web spaced radially outwards of said rotor shaft surface and said bridging member, said brush seal extending between said web and said bridging member.

3. A turbine according to claim 1 including a labyrinth seal having at least one tooth extending between said non-rotating component and said bridging member and spaced generally radially from said shaft surface.

4. A turbine according to claim 1 wherein said rotatable component includes a plurality of buckets having bucket dovetails for connection with complementary dovetails on a wheel of said rotatable component, said bridging member extending axially between and being connected to said bucket dovetails.

5. A turbine according to claim 4 including tongue-and-groove connections between the bridging member and the bucket dovetails.

6. A turbine according to claim 4 wherein said bridging member and portions of the rotatable and non-rotatable components define at least one wheelspace void radially inwardly of said bridging member.

7. A turbine according to claim 1 including a labyrinth seal having at least one tooth extending between said non-rotatable component and said bridging member and spaced generally radially from said rotor shaft surface, said labyrinth seal tooth being carried by said bridging member and extending radially outwardly toward said rotatable component.

8. A turbine according to claim 7 including a plurality of axially spaced labyrinth seal teeth carried by said bridging member and extending radially outwardly toward said non-rotatable component.

9. A turbine according to claim 7 wherein said bridging member and portions of the rotatable and non-rotatable components define at least one wheelspace void radially inwardly of said bridging member, said brush seal lying in contact with said bridging member at an axial location therealong in radial alignment with said void.

10. A turbine according to claim 9 including a plurality of axially spaced labyrinth seal teeth carried by said bridging member and extending radially outwardly toward said non-rotatable component.

11. A turbine according to claim 1 wherein said bridging member comprises a plurality of bridging elements arranged in an annular array about and in spaced relation to said shaft, said rotatable component including a plurality of buckets having bucket dovetails for connection with complementary dovetails on a wheel of said rotatable component, said bridging member extending between and being connected to said bucket dovetails.

12. A turbine according to claim 11 wherein each said bridging element has a circumferential extent in excess of the circumferential extent of the bucket dovetails.

13. A turbine according to claim 12 wherein each said bridging member has a circumferential extent of about 1.5 bucket pitches of the bucket dovetail.

14. A turbine according to claim 4 wherein said rotatable shaft includes a generally annular rim extending generally radially outwardly from said shaft surface and a fastening element between said rim and said bridging member connecting said rim and said bridging member to one another at a location intermediate axial end edges of said bridging member.

15. In a steam turbine having a rotatable component including a rotor shaft having a rotor shaft surface and a non-rotatable component about the rotatable component carrying a brush seal for sealing engagement with the rotatable component, a method of substantially eliminating bowing of the rotor resulting from circumferential non-uniform distribution of heat about the rotor shaft surface due to frictional contact between the brush seal and the rotatable component, comprising the step of inhibiting circumferential non-uniform heat transfer to the rotor shaft surface generated by frictional contact between the rotatable component and the brush seal by extending a bridging member between axially spaced bucket dovetails at a location radially outwardly of said rotor shaft, engaging said bridging member with said bucket rows and engaging the brush seal against the bridging member.

16. A method according to claim 15 including providing at least one labyrinth tooth on the bridging member for sealing with the non-rotatable component.

17. A method according to claim 15 including providing a rim projecting radially outwardly from the shaft surface between male dovetails for the buckets and mounting the bridging member on the rim.

18. A method according to claim 15 including mounting a plurality of bridging members between axially adjacent buckets at a radial location defining at least one void between said bridging member and the shaft radially inwardly of said bridging member.

19. A method according to claim 15 including securing axially opposite end edges of said bridging member to axially adjacent bucket dovetails by a tongue-and-groove connection.

20. A method according to claim 15 wherein the rotatable component includes axially spaced wheels having male dovetails and the bucket dovetails are configured for tangential entry along the male dovetails and including the step of disposing a plurality of bridging members in a tangential direction between the bucket dovetails to stack the bridging members against one another in a tangential direction.

* * * * *